US008959673B2

(12) United States Patent
Wherley

(10) Patent No.: US 8,959,673 B2
(45) Date of Patent: Feb. 24, 2015

(54) MULTI-PURPOSE BEADING FOR SWIMMING POOL LINERS

(75) Inventor: Clark Wherley, York, PA (US)

(73) Assignee: Fox Pool Corporation, York, PA (US)

( * ) Notice: Subject to any disclaimer, the term of this patent is extended or adjusted under 35 U.S.C. 154(b) by 478 days.

(21) Appl. No.: 13/300,954

(22) Filed: Nov. 21, 2011

(65) Prior Publication Data

US 2013/0061450 A1 Mar. 14, 2013

Related U.S. Application Data

(60) Provisional application No. 61/573,824, filed on Sep. 13, 2011.

(51) Int. Cl.
*E04H 4/00* (2006.01)
*E04H 4/14* (2006.01)

(52) U.S. Cl.
CPC ..... *E04H 4/14* (2013.01); *E04H 2004/147* (2013.01)
USPC ..... 4/506

(58) Field of Classification Search
CPC ..... E04H 4/0025
USPC ..... 4/488–513
See application file for complete search history.

(56) References Cited

U.S. PATENT DOCUMENTS

| | | | | | |
|---|---|---|---|---|---|
| 2,914,776 | A * | 12/1959 | Hotz | 4/499 |
| 4,335,474 | A * | 6/1982 | Bailey | 4/506 |
| 4,601,073 | A * | 7/1986 | Methot | 4/506 |
| 4,967,424 | A * | 11/1990 | Stegmeier | 4/496 |
| 4,980,934 | A * | 1/1991 | Dahowski et al. | 4/496 |
| 5,065,461 | A * | 11/1991 | Shehan et al. | 4/503 |
| 5,282,282 | A * | 2/1994 | Shehan et al. | 4/503 |
| 5,720,056 | A * | 2/1998 | Aymes | 4/488 |
| 6,209,151 | B1 * | 4/2001 | Schwimmer | 4/506 |
| 6,272,696 | B1 * | 8/2001 | Sobel et al. | 4/506 |
| 6,671,895 | B2 * | 1/2004 | Lewis | 4/506 |
| 7,165,296 | B2 * | 1/2007 | Coleman | 24/462 |
| 2008/0235862 | A1 * | 10/2008 | Lewis et al. | 4/506 |

* cited by examiner

*Primary Examiner* — Lori Baker
(74) *Attorney, Agent, or Firm* — Stuart J. Friedman

(57) ABSTRACT

An elongate beading for attaching a pool liner to a pool wall includes a substantially planar liner attachment portion having an outer surface for attachment to a pool liner and a hook portion having a pair of opposed first and second legs interconnected by a connector portion. The first and second legs and connector portion have inner surfaces defining a channel and the first leg is substantially coplanar with the liner attachment portion. The second leg defines with the connector portion a downwardly facing shoulder and includes a narrowing intermediate its ends which defines first and second sections, the second section being the free end portion which is separable from the first section. The free end portion tapers outwardly from the narrowing towards its free end, includes a plurality of spaced apart raised ribs on its surfaces and terminates in an enlarged protuberance.

8 Claims, 6 Drawing Sheets

MULTI-PURPOSE BEADING FOR SWIMMING POOL LINERS

CROSS-REFERENCE TO RELATED APPLICATIONS

This is a non-provisional application based upon U.S. provisional application Ser. No. 61/573,824, filed Sep. 13, 2011.

FIELD OF THE INVENTION

The present invention relates to a beading for use in attaching a swimming pool liner to an upper edge of a swimming pool wall and to a swimming pool liner including such a beading.

BACKGROUND OF THE INVENTION

One method of constructing swimming pools, particularly above-ground swimming pools, comprises the erection of fixed structural walls and a floor for the pool which are not watertight but which have sufficient structural strength to contain the water. A pool liner made of polyvinyl chloride or similar sheet material is then placed over the structural walls and floor of the pool to make it watertight. Swimming pool liners typically have a top peripheral edge portion that is attached at or adjacent to the top of the structural walls of the pool. Generally, a beading is used to attach the liner to or adjacent the top of the pool walls in order to ensure that the liner does not detach from the wall and slip down below the water line.

There are several ways in which a pool liner may be attached to a pool structural wall. One common technique is to have the beading overlap the top of the pool wall and act as a hook to hold the liner in place. Sometimes a cap is placed over the beading to secure the beading to the pool wall. Another common technique is to utilize a liner track formed by an S-hook or J-hook which has one end hooked over the pool wall and the other end defining a channel or track in which the beading is affixed to the pool wall.

Beading structures vary depending on the attachment style. Different types of beadings are required for different pool wall configurations. Some attempts have been made to provide a multi-purpose beading that can be used with more than one attachment style. For example, U.S. Pat. No. 6,209,151-Schwimmer and U.S. Pat. No. 6,671,895-Lewis and U.S. Patent Application Publication No. 2008/0235862-Lewis et al disclose dual purpose beadings for swimming pool liners that are used for attaching a pool liner to a pool wall either by hanging the beading over a pool wall or by securing the beading into a receptor type coupling, e.g., an S-hook or J-hook type coupling, attached to the pool wall.

SUMMARY OF THE INVENTION

It is, therefore, a primary object of the present invention to provide a novel and improved multiple purpose beading for attaching swimming pool liners to swimming pool walls.

It is also an object of the present invention to provide a novel and improved multiple purpose beading which can be used in conjunction with an S-hook or J-hook liner track for attaching a swimming pool liner to swimming pool walls.

It is another object of the present invention to provide a novel and improved multiple purpose beading which can attach a liner to a pool wall either by overlapping the pool wall or by insertion into the track of a bead receptor, such as an S-hook or J-hook.

It is yet another object of the present invention to provide a novel and improved multiple purpose beading which is versatile enough to attach after market swimming pool liners to existing pool walls having existing bead receptor tracks, which in some cases may be slightly too large for the liner beading, and to assure a sufficiently secure fit of the beading within the track to ensure that the liner does not detach from the wall and slip down below the water line.

It is still another object of the present invention to provide a method of attaching a pool liner to a pool wall utilizing a multiple purpose beading which is versatile enough to attach after market swimming pool liners to existing pool walls having existing bead receptor tracks, which in some cases may be slightly too large for the liner beading, and to assure a sufficiently secure fit of the beading within the track to ensure that the liner does not detach from the wall and slip down below the water line.

The foregoing and other objects are achieved in accordance with the present invention by providing in an elongate beading for attaching a pool liner to a pool wall, comprising:

a substantially planar liner attachment portion having an inner surface and an outer surface, the outer surface for attachment to a pool liner;

a hook portion having a pair of opposed first and second legs interconnected by a connector portion, said first and second legs and connector portion having inner and outer surfaces, the inner surfaces of said legs and connector portion defining a channel, said first leg being substantially coplanar with said liner attachment portion and said second leg defining with said connector portion a downwardly facing shoulder;

said hook portion being movable between a first position that enables said beading to be placed over an upper edge of a pool wall and a second position that enables said beading to be inserted into a bead-receiving track in or on a pool wall;

the improvement comprising:

said second leg including a narrowing intermediate its ends which defines first and second sections of said second leg, said first section being connected to said connector portion and said second section comprising a free end portion which is separable from said first section by tearing or cutting at said narrowing, said free end portion tapering outwardly from the narrowing towards its free end and including a plurality of spaced apart raised ribs on its inner and outer surfaces, said free end terminating in an enlarged protuberance;

whereby said separable second section is movable between a first position attached to said first section of said second leg and a second position separated from said first section and inserted in a bead-receiving track to wedge said beading securely within the track.

In another aspect of the invention the connector portion has a generally trapezoidal shape, the first and second legs intersect the corresponding side walls of said connector portion for defining therewith two downwardly facing shoulders, the shoulders extending between the outer surface of the respective legs and the outer surface of the adjacent side walls of the connector portion.

In still another aspect of the invention the length of the shoulder between the second leg and the adjacent side wall of the connector portion is longer than the length of the shoulder between the first leg and the adjacent side wall of the connector portion.

In yet another aspect of the invention a pool liner-beading assembly is provided comprising a pool liner attached to the elongate beading of the present invention.

In still another aspect of the invention there is provided a method for attaching a pool liner to a pool wall using a hook which includes an upwardly opening bead-receiving track having an inwardly protruding lip and a substantially vertically extending shank remote from said lip, comprising the steps of:

a) inserting the connector portion of an elongate beading having the features set forth hereof into said track in such a manner that a space is defined between said connector portion and said shank;

b) separating the second section of said second leg from the first section of said second leg at the narrowing therebetween;

c) leading with the smallest thickness end of the second section, inserting said second section into said space and forcing said second section into said space as far as it can be inserted, whereby said second section acts a wedge filling said space and forcing said shoulder into engagement with said lip and said connector portion to press against said shank through the intermediary of said second section.

DETAILED DESCRIPTION OF THE INVENTION

Figure 1:
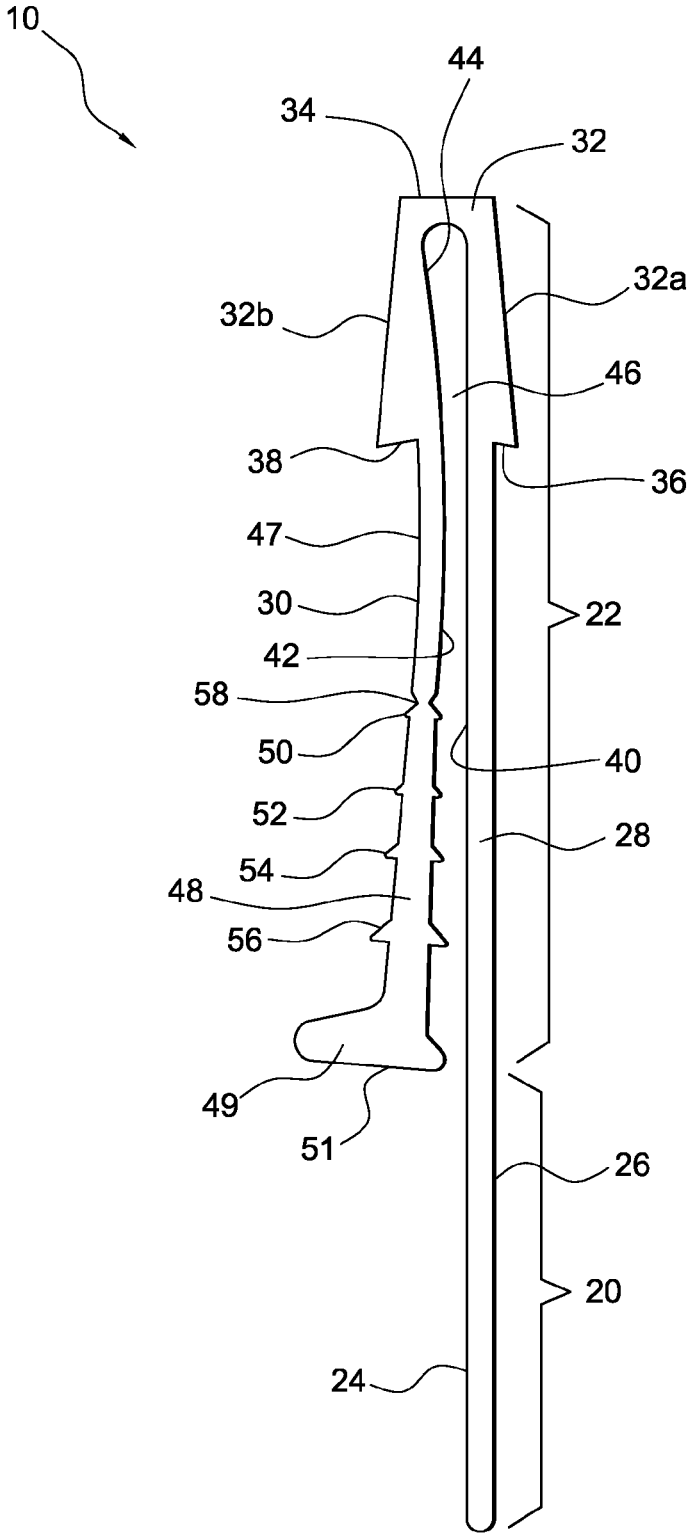
FIG. 1 is a side elevational view of the multiple purpose beading of the present invention.
Figure 2:
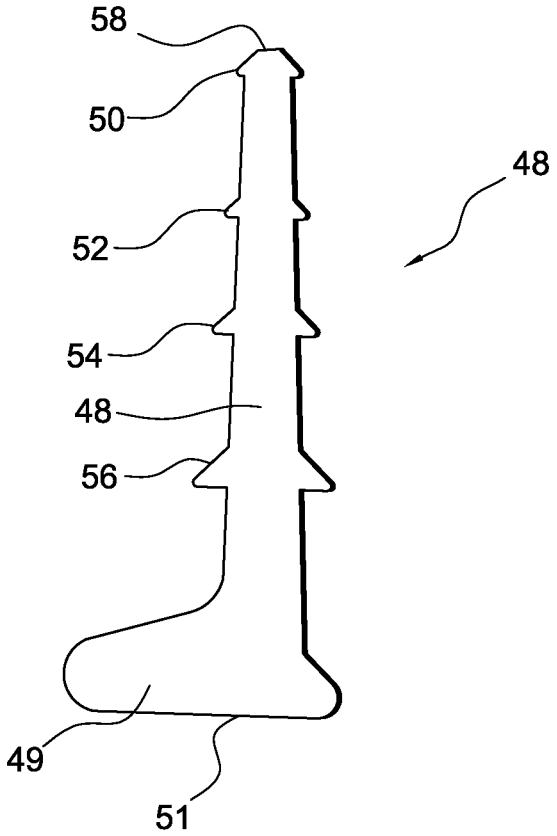
FIG. 2 is a side elevational view of the free end portion of the second leg of the beading detached from the remainder of the beading.
Figure 3:
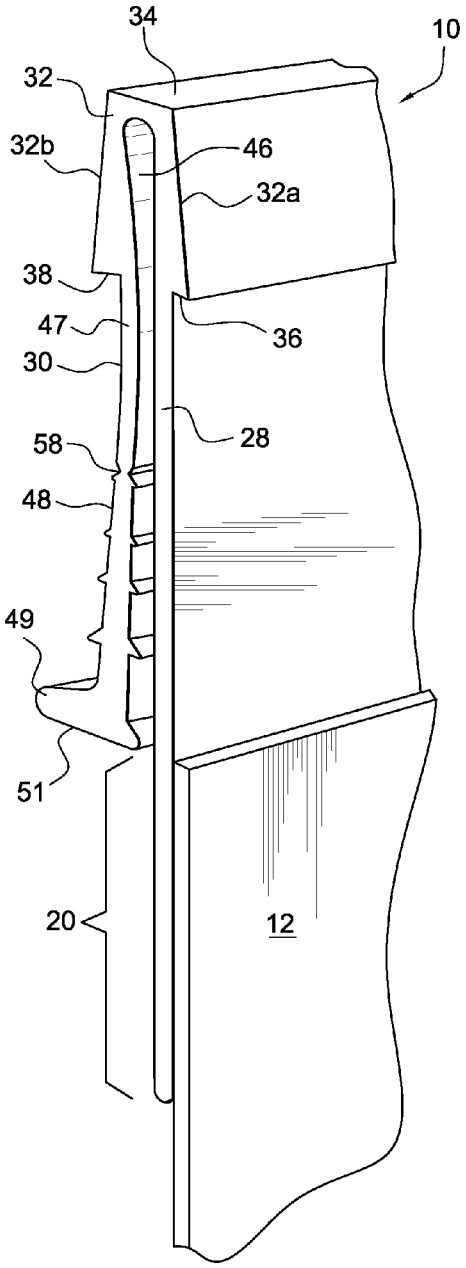
FIG. 3 is a perspective view of the multiple purpose beading of FIG. 1 attached to a pool liner.
Figure 4:
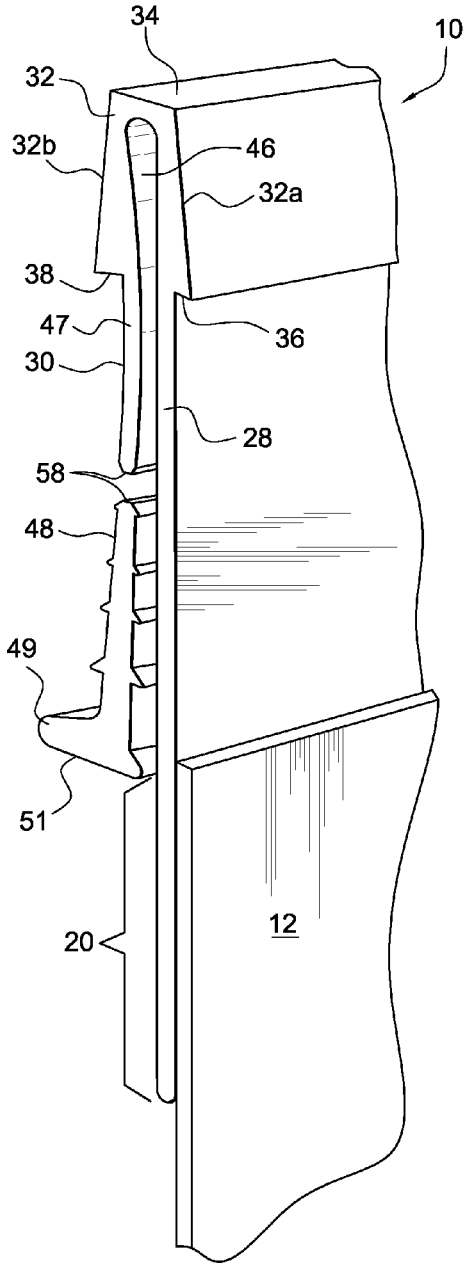
FIG. 4 is a perspective view as in FIG. 3 with the free end portion of the second leg of the beading detached from the remainder of the beading.

Referring to FIGS. 1-5, the beading 10 of the present invention is generally useful for attaching a pool liner 12 to the upper ends of the structural walls 14 of an above-ground pool. Beading 10 comprises an elongate liner attachment portion 20 and a hook portion 22. Liner attachment portion 20 has an inner surface 24 and a substantially planar outer surface 26 to which the upper end portion of an inner surface of a pool liner 12 is adhered. Pool liner 12 is constructed of a strong and flexible material suitable for use with swimming pools such as, but not limited to, flexible polyvinyl chloride sheet. Pool liner 12 is permanently adhered or bonded to outer surface 26 of liner attachment portion 20 by any of a number of methods known in the art for adhering such materials, including, but not limited to, RF sealing, heat sealing, impulse welding, solvent bonding and ultrasonic welding.

Hook portion 22 includes a first leg 28 which, desirably, is a substantially coplanar extension of liner attachment portion 20, and an opposed second leg 30 interconnected by a connector portion 32. The side walls 32*a*, 32*b* of connector portion 32 desirably flare outwardly from upper end 34 of connector portion 32 to their intersection with first and second legs 28, 30, giving the connector portion 32 a generally trapezoidal shape which includes downwardly facing, i.e., liner-facing, shoulders 36, 38 at the intersection of side walls 32*a*, 32*b* with first and second legs 28, 30, respectively. Inner surface 40 of first leg 28, inner surface 42 of second leg 30 and inner surface 44 of connector portion 32 together define a downwardly opening, substantially inverted U-shaped channel 46 within hook portion 22. Channel 46 is structured and arranged to snugly receive an upper end region of a swimming pool wall 14.

Figure 7:
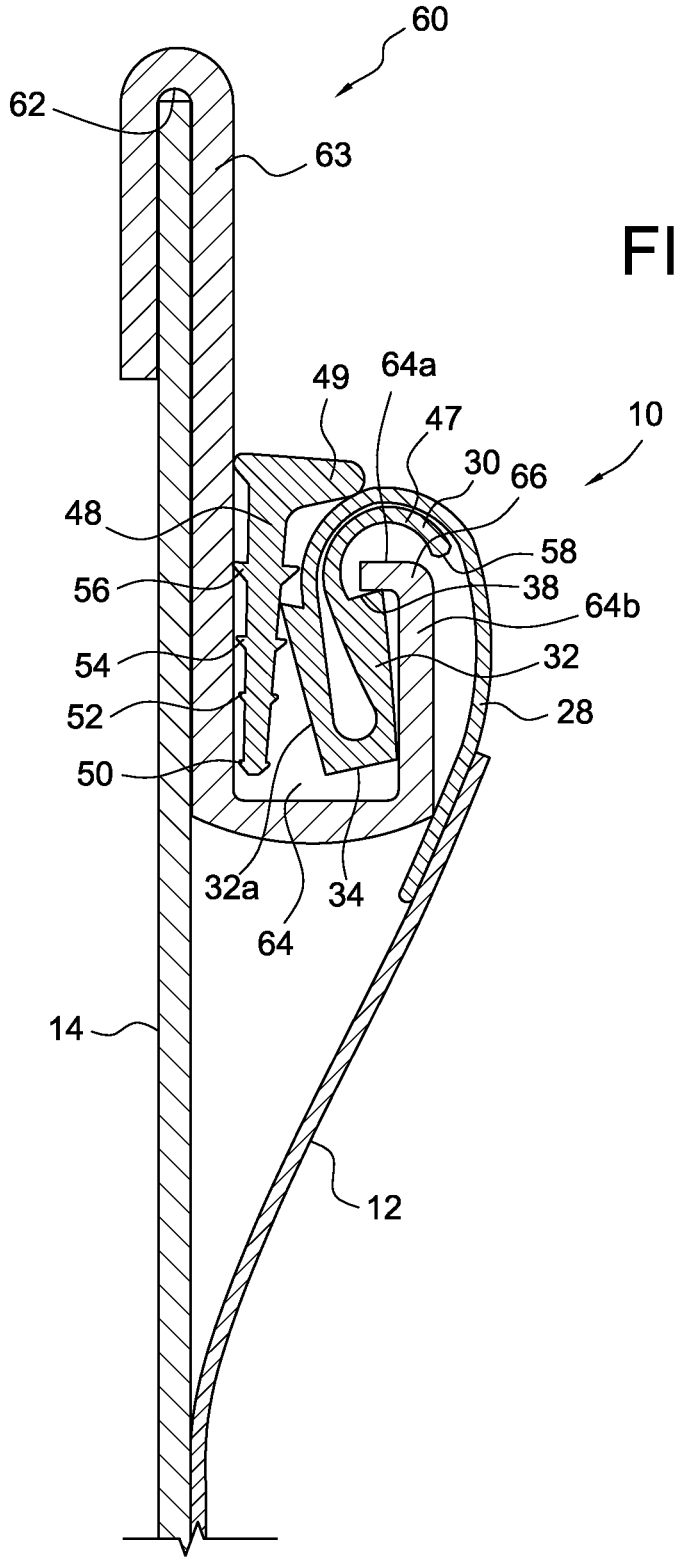
FIG. 7 is a cross-sectional view as in FIG. 6 wherein the beading is connected to an oversized S-hook liner track attached to a pool wall and the free end portion of the second leg of the beading is wedged into the S-hook liner track to securely hold the beading within the track.

Different pool manufacturers utilize bead-receiving tracks which vary in size, i.e., there is no absolutely standard size, although the tracks are more or less similar in size. However, in view of the large force exerted by the water on the swimming pool liner, the liner beading may be pulled out of the track and the liner slip down below the water line if the beading is loose within the track. This is particularly a problem when liner beads of after-market liners are attached within pre-existing tracks which may be slightly too large for the liner bead. To remedy this situation, referring to FIGS. 1-4, second leg 30 includes a perforation, notch, groove, score mark, or other point of weakness 58, hereinafter referred to as a narrowing in the second leg 30, which divides second leg 30 into a first section 47 connected to connector portion 32 and a second section comprising free end portion 48. Free end portion 48 may be torn or cut away and separated from first section 47 at narrowing 58. Once separated, as shown in FIG. 7 and as will be more fully described hereinafter, free end portion 48 may be inserted in a bead-receiving track to wedge connector portion 32 securely within the track so that the force of the water on liner 12 will not pull connector portion 32 out of the track. The free end portion 48 of second leg 30 tapers outwardly from narrowing 58 towards its free end 51 such that the thickness of the free end portion 48 increases toward its free end 51 and terminates in an enlarged, outwardly extending protuberance 49. Free end portion 48 includes a plurality of spaced apart raised ribs 50, 52, 54, 56 on opposing inner and outer surfaces between narrowing 58 and free end 51.

Beading 10 is desirably formed by extrusion of a durable, watertight, flexible material suitable for use with a swimming pool, such as, but not limited to, polyvinyl chloride. Other materials, however, may be selected to accommodate the particular configuration and dimensions of a swimming pool liner and swimming pool wall. The length of beading 10 is determined by the dimensions of the pool since beading 10 is continuous along the peripheral dimension of the pool. It is understood, however, that beading 10 can be of any size, dimension and circumference to accommodate the use, size, dimension and circumference of a specific pool liner and swimming pool.

Figure 5:
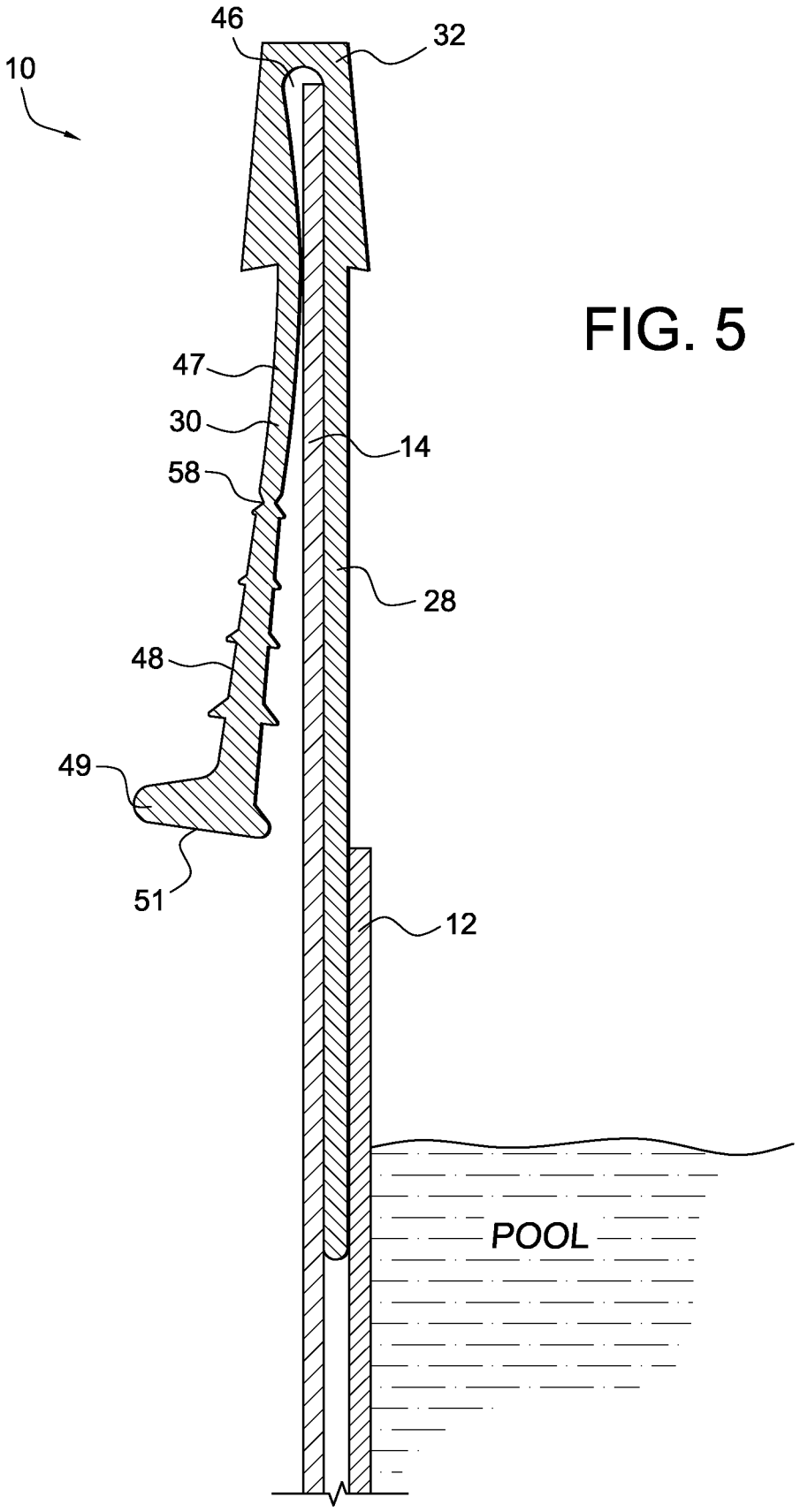
FIG. 5 is a cross-sectional view of the beading-liner assembly shown in FIG. 3, wherein the beading is attached to a pool wall in an overlap configuration.

Referring to FIG. 5, beading 10 is shown in a first attachment configuration used with above-ground swimming pools that have vertical structural walls, such as overlap-type or rotationally molded swimming pools. Beading 10 is secured to pool wall 14 by inserting the upper end region of pool wall 14 into channel 46. Channel 46 is structured and arranged to snugly receive the upper end region of pool wall 14. Desirably, inner surface 24 of liner attachment portion 20 and inner surface 40 of first leg 28 lie flush against the inner surface of pool wall 14.

Figure 6:
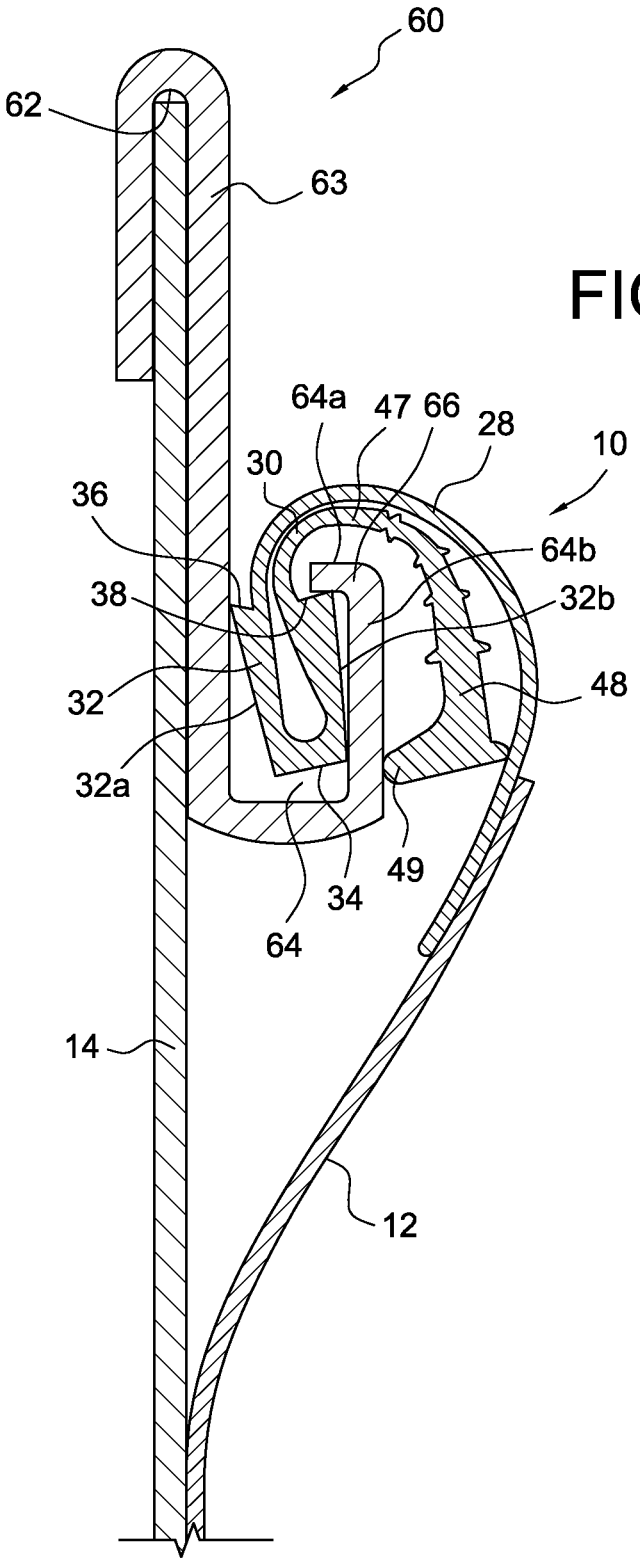
FIG. 6 is a cross-sectional view of the beading-liner assembly shown in FIG. 3, wherein the beading is received within an S-hook pool liner track attached to a pool wall.

Referring now to FIGS. 6 and 7, beading 10 is shown in another attachment configuration in use with a bead-receiving liner track, specifically the liner track of a J-hook or S-hook 60, which connects beading 10 to a pool wall 14. An S-hook, for example, is generally "S" shaped with an upper hannel 62 opening in a downward direction, a lower track 64 opening in an upward direction and a shank portion 63 interconnecting channel 62 and track 64. Typically upper channel 62 has a narrower width than lower track 64 because its purpose is to receive the upper end region of pool wall 14. Lower track 64 faces into the pool and is intended to receive beading 10 therewithin. For this purpose lower track 64 has a lip 66 that protrudes from its free end inwardly toward and spaced from shank 63. First and second legs 28, 30 of beading 10 are pressed together and are bent over the lip 66 of lower track 64 and inserted into lower track 64. Lip 66 of lower track 64 prevents beading 10 from being pulled from track 64 by engaging shoulder 38 while upper end 34 and/or side wall 32*a* of connector portion 32 presses against shank portion 63. Desirably, side wall 32*b* of connector 32 is thicker than side wall 32*a* and shoulder 38 is longer than shoulder 36 to facilitate engagement of shoulder 38 with lip 66 and to assure sufficient beading strength to resist being pulled from track 64. Assuming that lower channel 64 is properly sized for beading 10, free end portion 48 remains attached to first section 47 of second leg 30, lip 66 locks beading 10 onto S-hook 60 while shank portion 63 ensures that hook portion 22 does not straighten and fall off S-hook 60.

In many instances, particularly where after-market pool liners are to be attached to existing track, lower track 64 is too large for beading 10. In such a case lip 66 will not securely engage and lock beading 10 onto S-hook 60 and, likely, upper end 34 and/or side wall 32*a* of connector portion 32 will not be able to assure that hook portion 22 does not straighten and fall off S-hook 60. The result will be that beading 10 will be pulled out of lower track 64 and the liner will slip down below the water line. According to the present invention, this result can be avoided by tearing away or cutting free end portion 48 at narrowing 58 from the first section 47 of second leg 30. It will be appreciated that free end portion 48 is contoured so as to permit its insertion into a track which already houses a pool liner beading, albeit not securely. The separated free end portion 48 has the same circumferential length as the liner 12 and can be inserted within lower track 64 in the space between connector portion 32 of beading 10 and shank 63 of S-hook 60, leading with the smallest thickness end of free end portion 48, i.e., the end remote from protuberance 49. Free end portion 48 is forced into the space between connector side wall portion 32*a* and shank 63 as far as it can be inserted by the installer pushing on the large surface area of protuberance 49, and acts as a wedge filling that space. Free end portion 48 may be inserted into this space because it is sufficiently semi-rigid that it does not bend upon meeting the resistance encountered during insertion. On the other hand, beading 10 must be sufficiently flexible for first and second legs 28, 30 to be pressed together and bent over lip 66 for insertion into lower track 64. Ribs 50, 52, 54, 56 on free end portion 48 are formed so as not to impede the insertion of free end portion 48 into the space but, rather, to frictionally engage connector side wall 32*a* and S-hook shank 63 in order to aid in the locking of the free end portion 48 within the space therebetween and, ultimately, to aid in maintaining beading 10 within track 64. The effect of wedging free end portion 48 into the space between connector portion 32 and shank 63, around the entire length of liner 12, is to force lip 66 into engagement with shoulder 38 and to cause upper end 34 and/or side wall 32*a* of connector portion 32 to press against shank portion 63 through the intermediary of the free end portion 48. As a consequence, lip 66 locks beading 10 onto S-hook 60 while shank portion 63 ensures that hook portion 22 does not straighten and fall off S-hook 60.

While the present invention has been described in terms of specific embodiments thereof, it will be understood that no limitations are intended to the details of construction or design other than as defined in the appended claims.

The invention claimed is:

1. In an elongate beading for attaching a pool liner to a pool wall, comprising:

a substantially planar liner attachment portion having an inner surface and an outer surface, the outer surface for attachment to a pool liner;

a hook portion having a pair of opposed first and second legs interconnected by a connector portion, said first and second legs and connector portion having inner and outer surfaces, the inner surfaces of said legs and connector portion defining a channel, said first leg being substantially coplanar with said liner attachment portion;

said hook portion being movable between a first position that enables said beading to be placed over and receive an upper edge of a pool wall within said channel and a second position that enables said beading to be inserted into a bead-receiving track in or on a pool wall;

the improvement comprising:

said connector portion having side walls and said first and second legs intersecting said connector portion for defining with said side walls two downwardly facing shoulders, said shoulders extending between the outer surface of the respective legs and the outer surface of the adjacent side walls of said connector portion, the length of the shoulder and the thickness of the side wall between the second leg and the adjacent side wall being greater than the length of the shoulder and the thickness of the side wall between the first leg and the adjacent side wall of the connector portion;

said second leg including a narrowing intermediate its ends which defines first and second sections of said second leg, said first section being connected to said connector portion and said second section comprising a free end portion which is separable from said first section by tearing or cutting at said narrowing, said free end portion tapering outwardly from the narrowing towards its free end and including a plurality of spaced apart raised ribs on its inner and outer surfaces, said free end terminating in an enlarged protuberance;

said separable second section being movable between a first position attached to said first section of said second leg and a second position separated from said first section and inserted in a bead-receiving track to wedge said beading securely within the track.

2. The elongate beading, as claimed in claim 1, wherein said channel is a downwardly opening, substantially inverted U-shaped channel.

3. The elongate beading, as claimed in claim 1, wherein said track is an S-hook or J-hook liner track.

4. In a pool liner-beading assembly for attaching a pool liner to a pool wall, comprising:

a pool liner; and an elongate beading, comprising:

a substantially planar liner attachment portion having an inner surface and an outer surface, the outer surface of said liner attachment portion attached to said pool liner;

a hook portion having a pair of opposed first and second legs interconnected by a connector portion, said first and second legs and connector portion having inner and outer surfaces, the inner surfaces of said legs and connector portion defining a channel, said first leg being substantially coplanar with said liner attachment portion;

said hook portion being movable between a first position that enables said beading to be placed over and receive an upper edge of a pool wall within said channel and a second position that enables said beading to be inserted into a bead-receiving track in or on a pool wall;

the improvement comprising:

said connector portion having side walls and said first and second legs intersecting said connector portion for defining with said side walls two downwardly facing shoulders, said shoulders extending between the outer surface of the respective legs and the outer surface of the adjacent side walls of said connector portion, the length of the shoulder and the thickness of the side wall between the second leg and the adjacent side wall being greater than the length of the shoulder and the thickness of the side wall between the first leg and the adjacent side wall of the connector portion;

said second leg including a narrowing intermediate its ends which defines first and second sections of said second leg, said first section being connected to said connector portion and said second section comprising a free end portion which is separable from said first section by tearing or cutting at said narrowing, said free end portion tapering outwardly from the narrowing towards its free end and including a plurality of spaced apart raised ribs on its inner and outer surfaces, said free end terminating in an enlarged protuberance;

said separable second section being movable between a first position attached to said first section of said second leg and a second position separated from said first section and inserted in a bead-receiving track to wedge said beading securely within the track.

5. The pool liner-beading assembly, as claimed in claim 4, wherein said channel is a downwardly opening, substantially inverted U-shaped channel.

6. The pool liner-beading assembly, as claimed in claim 4, wherein said track is an S-hook or J-hook liner track.

7. The elongate beading, as claimed in claim 1, wherein said connector portion has a generally trapezoidal shape.

8. The pool liner-beading assembly, as claimed in claim 4, wherein said connector portion has a generally trapezoidal shape.

* * * * *